United States Patent [19]

Semenenko

[11] 4,061,008

[45] Dec. 6, 1977

[54] ROLLS OF A SKEWED-ROLL MACHINE FOR TRUEING CYLINDRICAL METAL ARTICLES

[76] Inventor: Jury Lukich Semenenko, ulitsa Gogolya, 1, kv. 30, Dnepropetrovsk, U.S.S.R.

[21] Appl. No.: 740,735

[22] Filed: Nov. 10, 1976

[51] Int. Cl.[2] ..... B21D 3/04

[52] U.S. Cl. ..... 72/98; 72/99

[58] Field of Search ..... 72/98, 99, 100

[56] References Cited

U.S. PATENT DOCUMENTS

| | | | |
|---|---|---|---|
| 388,574 | 8/1888 | Muncaster | 72/100 |
| 1,859,851 | 5/1932 | Stiefel | 72/100 |

FOREIGN PATENT DOCUMENTS

| | | | |
|---|---|---|---|
| 719,625 | 6/1942 | Germany | 72/99 |

*Primary Examiner*—Lowell A. Larson
*Attorney, Agent, or Firm*—Fleit & Jacobson

[57] ABSTRACT

The invention relates to rolls of a skewed-roll machine. The rolls include a back-up roll and a pressure roll, having their axes extending at an angle to each other and at an angle to the trueing axis. The back-up roll has a biconcave profile, the portions of this roll, adjoining its ends, having the same hyperboloidal concavity with the degree of curvature providing for the engagement of the roll with the narrow central portion of the article being trued. The central portion of the back-up roll has hyperboloidal concavity with a degree of curvature to perform the trueing by bending the thickened end portion of the article being trued. The other roll, i.e. the pressure one, has a convexo-concave profile with similar hyperboloidal concave portions adjoining its ends, providing for the engagement of the roll with the thickened end of the article being trued, the roll further having a convex central portion as a projecting strip of a curvilinear profile, with a radial projection having a height ensuring a bending torque which, at the bending of the narrow central portion of the article being trued is short of the maximum permissible value of the bending torque but is not short of the minimum permissible bending torque required for trueing the thickened end of the article being trued, provided that the plastic torque of the bending resistance of the cross-section of the thickened end portion of the article being trued exceeds the plastic torque of the bending resistance of the cross-section of the narrow portion by not more than 10%.

2 Claims, 6 Drawing Figures

ROLLS OF A SKEWED-ROLL MACHINE FOR TRUEING CYLINDRICAL METAL ARTICLES

BACKGROUND OF THE INVENTION

The invention relates to an apparatus for trueing cylindrical articles and, more particularly, it relates to rolls of skewed-roll machines for trueing cylindrical metal articles.

The disclosed trueing rolls can be employed in skewed-roll trueing machines for trueing the entire length of cylindrical metal articles, either solid or hollow, wherein the diameter of the end portions of the articles exceeds the diameter of the central portion, e.g. tubes and pipes with flaring ends, shafts with thickened end portions, etc.

Known in the art are skewed roll couples for trueing tubes and rods of a circular cross-section. These couples are usually provided with at least one skewed couple of bending rolls, offset with respect to the trueing axis and mounted intermediate support roll couples, at least one couple performing the trueing of the article by bending. The opposing rolls in such couples are spaced so and mounted at such an angle with respect to each other that upon the rotation of the rolls the article being trued should be subjected to the required pulling effort. During the trueing operation, the trued portion of the article is supported by two supporting side coupled rolls and is bent by the central bending roll couple, offset from the trueing axis. With the article rotating, it is subjected to sign-variable elasto-plastic bending or flexing required for eliminating the curvature of the trued portion of the article. Owing to the trueing rolls being mounted at an angle to the trueing axis, the article is driven through a helical motion and, with the article rotating, it is subjected to repeated sign-variable elasto-plastic bending or flexing and trueing throughout the entire length thereof, in every plane including the longitudinal axis of the article. To handle a broad range of sizes of tubes and rods, the present-day skewed-roll trueing machines incorporate mechanisms for adjusting the spacing of the trueing rolls and the angle of their inclination with respect to the trueing axis.

There are also known single skewed rolls mounted in trueing machines in a checkered order, i.e., the rolls of one row being support or back-up ones and the rolls of an adjacent row being bending ones ensuring that an article is bent while being trued, owing to their axes being offset from the trueing axis. These rolls are used for trueing by flexing both cylindrical articles having no thickened ends and the narrow central portions of cylindrical articles having thickened ends. In this case the trueing of the articles with thickened ends does not require the resilient suspension of the single rolls, since the thickened end of the article throughout the trueing operation rides free of the single rolls and passes unobstructedly between the rows of the rolls, while the narrow central portion is being trued by sign-variable bending or flexing. However, with this roll arrangement the thickened ends are not trued and just pass free through a trueing machine.

With the usual fixed arrangement of roll couples the spacing of the opposing rolls does not vary during a trueing operation. Whereby it is virtually impossible to true articles with thickened ends, because in the process of a trueing operation it is impractical to increase the spacing of the opposing rolls of the couples to let pass the thickened end of an article. To true articles with thickened ends, resilient suspension of the rolls has been resorted to, with the rolls being mounted by means of shock absorbers. In resiliently mounted roll couples the narrow central portion of an article with thickened ends can be trued, because during the trueing operation the roll couples are able to spread with aid of their resilient mountings to let the thickened end of an article pass, whereafter they move back closer together to true the narrow portion of an article. However, this trueing has proved to be of inadequate accuracy, since only the narrow portion of the article is really trued, whereas the thickened ends thereof remain untrued.

There are further known rolls for trueing articles with end portions of an increased diameter, such as tubes with outwardly offset or flaring ends, mounted in three-roll sets associated with mechanisms for pre-spacing of the sidemost rolls of these three-roll sets prior to trueing an article, e.g. a tube, so as to ensure that the spacing of the rolls provides for the passage of the outwardly offset end of the article, i.e. of the tube. The arrangement of such rolls includes two three-roll support or back-up sets, there being mounted centrally intermediate these two three-roll support sets a single bending role offset with respect to the trueing axis, designed to bend an article, e.g. a tube to be trued. In the process of the trueing operation the article, e.g. a tube is driven through a helical motion, each portion, bearing upon the three-roll support or back-up sets, being bent by the bending roll and trued by sign-variable bending or flexing. However, these rolls, the same as the previously described ones, are capable of trueing only the narrow portions of an article, e.g. a tube, while the thickened, e.g. flaring or outwardly offset ends of the article pass through without trueing.

Thus, all the hitherto known sets of skewed rolls of trueing machines do not provide for trueing the thickened end portions of an article, their sole function being that of trueing the narrow portion of the article, the thickened end portions thereof are let through without trueing. This may be explained by the fact that all the hitherto known rolls used for trueing articles of a cylindrical shape with thickened end portions would not provide for trueing the thickened ends of the articles in a roll set made up by two rolls.

There are widely known rolls for trueing cylindrical articles in a single two-roll set consisting of a single support or back-up roll and a single pressure or bending roll, both rolls being mounted at an angle to the trueing axis. In such a roll set the support roll is concave, and the pressure roll either convex or cylindrical. While being trued, the portion of the article, which is being acted upon, bears upon the two side contact areas of the support roll and is bent by the central contact area of the bending pressure roll.

However, the profiles of this known single roll couple do not provide for trueing the thickened end portions of cylindrical articles.

The unavailability of rolls capable of trueing the thickened end portions of cylindrical articles requires the use of auxiliary equipment for the purpose, which affects the overall productivity of labor and increases the cost of trueing.

SUMMARY OF THE INVENTION

It is an object of the present invention to provide the rolls of a skewed-roll trueing machine for trueing cylindrical articles, which enable trueing of a cylindrical article with thickened end portions in a single passage through a single roll set made up by two rolls, with both the narrow central portion of the article and the thickened end portions thereof being trued.

This and other objects are accomplished by the disclosed rolls of a skewed-roll trueing machine for trueing cylindrical metal articles, which are driven from a motor and form a roll couple, wherein one roll is a support or back-up roll with two article support portions adjoining the ends of this roll and the other roll is the pressure roll and has a bending portion mounted intermediate the article-support portions of the support roll, providing for sign-variable bending or flexing of an article being trued. The two rolls are mounted so that the respective axes thereof extend at an angle to the trueing and the initial spacing of the rolls corresponds to the diameter of the article being trued, whereby the latter is driven by the rotation of the rolls through a helical motion, while being at the same time trued. According to the present invention, the support or back-up roll is made in the form of a body of rotation with a biconcave profile, the portions of the support roll, adjoining the end faces thereof, being of the same hyperboloidal concavity with the degree of curvature providing for snug engagement of the roll with the narrow central portion of the article. The central portion of the support roll is of hyperboloidal concavity with the degree of curvature providing for the bending of the thickened end of the article, so as to true the latter. The pressure roll is made in the form of a body of rotation of a convexoconcave profile, with the portions adjoining the ends thereof being hyperboloidally concave with the degree of curvature providing for the engagement of the roll with the thickened end portion of the article. The central portion of the pressure roll is convex and made in the form of a projecting strip of a curvilinear profile, with a projection of a height creating a bending torque of a value which at the trueing of the narrow central portion of the article is short of the maximum permissible value of the bending torque $\sigma_b W_{s1}$ but is not short of the minimum permissible value of the bending torque $\sigma_s W_{s2}$ required for trueing the thickened end portion of the article, providing that the plastic torque $W_{s2}$ of the bending resistance of the cross-section of the thickened end portion of the article exceeds the plastic torque $W_{s1}$ of the bending resistance of the narrow central portion of the article by not more than 10%, where $\sigma_b$ is the ultimate strength of the material of the article;

$\sigma_s$ is the yield limit in elongation of the material of the article;

$W_{s1}$ is the plastic torque of the bending resistance of the cross-section of the narrow central portion of the article and $W_{s2}$ is the plastic torque of the bending resistance of the thickened end portion of the article.

According to the present invention, there have been provided rolls for a skewed-roll trueing machine for trueing cylindrical metal articles, for enabling trueing of an article having thickened end portions in a set made up by two rolls in a single pass of the article, with both the narrow central portion of the latter and the thickened ends thereof being trued.

When trueing metal articles by elasto-plastic bending, it is necessary to create a bending torque of a value ensuring that within the surface layer of the article, subjected to elongation, the strain exceeds the yield limit $\sigma_s$ of the material, but is short of the ultimate strength $\sigma_b$ thereof. The bending torque is to be in excess of the maximum elastic one (i.e. the one corresponding to the production within the surface layer of the article of strain equalling the yield limit $\sigma_s$), and at the same time it is to be short of the maximum plastic torque (i.e. the one corresponding to the strain in the surface layer reaching up to the ultimate strength $\sigma_b$). As there is always a gap between the values of the ultimate strength $\sigma_b$ and yield limit $\sigma_s$, it is possible to true articles without their destruction at any value of the bending torque within a range limited by its minimum and maximum values $\sigma_s W$ and $\sigma_b W_s$ (where W and $W_s$ are, respectively, the elastic and plastic torques of the bending resistance of the cross-section of the article). The calculation value of the bending torque at trueing is usually taken to equal $\sigma_s W_s$, where $W_s = 4/3R^3$ for a circular cross-section and $W_s = 4/3(R^3 - r^3)$ for a tubular cross-section, R and $r$ being, respectively, the external and internal radii of a tube. At bending, it is permissible that the bending torque may fluctuate within a specified range, the existance of the above-mentioned positive difference or gap between the values of the ultimate strength $\sigma_b$ and yield limit $\sigma_s$ being responsible for such fluctuations being possible. In industrial practice, such fluctuations of the bending torque required for trueing an article are brought about by the fluctuations of the following values: the initial curvature of the article prior to the trueing the cross-sectional dimensions of the articles, the mechanical properties of the material and the trueing temperature. Since for the majority of the materials of everyday engineering use the difference of the relative deformation values at the ultimate strength and yield limit is not below 10%, it may be stated that the trueing of such articles with adequate quality can be attained with the relative difference between the maximum and minimum bending torque values being up to 10%. This fact enables the trueing of cylindrical articles with thickened end portions under a condition that the relative difference between the bending torque required for trueing the thickened end portion and that required for trueing the narrow central portion should not exceed 10%, because the material of an article with thickened end portions is the same throughout the length thereof, and the calculation value of the yield limit of the material throughout the length of the article is permanent and equals $\sigma_s$.

The plastic torque of the bending resistance of the cross-section of an article with thickened end portion amounts to the maximum value $W_{s\,max}$ for the thickened ends and the minimum value $W_{s\,min}$ for the narrow central portion of the article. Thus, the difference between the maximum and minimum bending torque values is:

$$M_{max} - M_{min} = \sigma_s W_{s\,max} - \sigma_s W_{s\,min} = \sigma_s (W_{s\,max} - W_{s\,min}).$$

The permissible maximum relative difference between the bending torque values then equals Mmax−λ Mmin/Mmin 100% = 10%; hence, the maximum permissible relative difference between the plastic torques of resistance (providing that the value of $\sigma_s$ does not differ throughout the length of the article) equals:

$$W_{s\,max} - W_{s\,min}/W_{s\,min}\,100\% = 10\%.$$

It is, therefore, clear that trueing cylindrical articles with thickened end portions with adequate quality is possible when the relative difference between the maximum (for the thickened end portion) and minimum (for the narrow central portion) values of the plastic torque of bending resistance of the cross-sections of the article does not exceed 10%.

For the present invention to be better understood, there will be described hereinbelow an embodiment thereof, with reference being made to the accompanying drawings, wherein.

Figure 1:
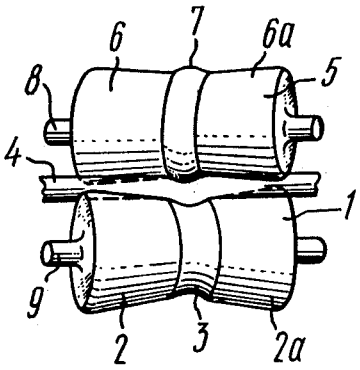
FIG. 1 shows schematically the rolls of a skewed-roll trueing machine for trueing cylindrical metal articles, constructed in accordance with the invention.
Figure 2:
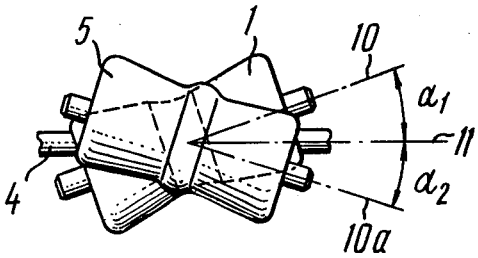
FIG. 2 is the plan view of the rolls of FIG. 1.

The support or back-up roll 1 (FIGS. 1 and 2) is made in the form of a body of rotation with a bicancave profile, the portions 2 and 2*a* of the roll, adjoining the ends thereof, being hyperboloidally concave with the same curvature, to provide for snug engagement of the roll with an article, while the central portion 3 of the roll is likewise hyperboloidally concave, but with a curvature which is greater than that of the portions 2*a* and 2. The curvature of the portion 3 is such that it should provide for the bending of the thickened end of an article, required for trueing the latter. The support or back-up roll 1 is adapted to have an article 4 to be trued to bear thereupon, the article having thickened or increased-diameter end portions.

The pressure roll 5 is made in the form of a body of rotation with a convexo-concave profile, the portions 6 and 6*a* adjoining the ends of the roll 5 being hyperboloidally concave with the same curvature, while the portion 7 intermediate the portions 6 and 6*a* is an outstanding convex strip of a curvilinear profile with the extent of the radial projection 7*a* of such a height that at the trueing of the narrow central portion of the article, the projection produces a bending torque of a value not exceeding the maximum permissible value of the bending torque $\sigma_b W_{s1}$ and not short of the minimum permissible value of the bending torque $\sigma_s W_{s2}$ required for trueing the thickened end of the article, providing that the plastic torque $W_{s2}$ of the bending resistance of the cross-section of the thickened end portion of the article exceeds the plastic torque $W_{s1}$ of the bending resistance of the cross-section of the narrow central portion of an article by no more than 10%;

where $\sigma_b$ is the ultimate strength of the material of the article;

$\sigma_s$ is the yield limit of the material of the article;

$W_{s1}$ is the plastic torque of bending resistance of the cross-section of the narrow central portion of the article and $W_{s2}$ is the plastic torque of bending resistance of the cross-section of the thickened end portion of the article.

The pressure roll 5 is adapted to bear upon the article 4 being trued. The rolls 1 and 5 are provided with journals 8 and 9 for mounting the rolls in the housing of a skewed-roll trueing machine.

Figure 3:
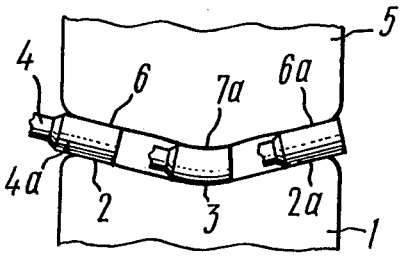
FIG. 3 illustrates the pattern of trueing the thickened end portion of a cylindrical article.
Figure 4:
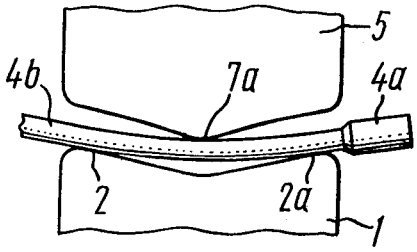
FIG. 4 illustrates the pattern of trueing the narrow central portion of a cylindrical article.

The portions 2, 3 and 2*a* (FIG. 3) of the support or back-up roll 1 and the portions 6, 7 and 6*a* of the pressure roll 5 make up jointly a trueing pass capable of effecting centering and rolling of the thickened end portions 4*a* of the article 4, as well as the trueing-wise bending of both the narrow central portion 4*b* (FIG. 4) of the article and the thickened end portions 4*a* thereof, as the article 4 is being trued.

The dimensions and the curvature of the endmost concave portions 2 and 2*a* of the support roll 1 and of the concave portions 6 and 6*a* of the pressure roll 5 are selected so as to ensure the engagement between the narrow central portion 4*b* of an article and the rolls, as well as the required centering, and bending of the thickened end portions 4*a* of the article 4, the actual value of the curvature being determined depending on the cross-sectional dimensions of the articles to be trued, their maximum curvilinearity and the physical properties of their material; the greater the cross-sectional dimensions, the maximum initial curvilinearity and the values of the physical characteristics of the articles, the greater the curvature of the portions 2, 2*a* and 6, 6*a* should be. The curvature of the portions 2, 2*a* and 6, 6*a*, on the other hand, should be sufficient for producing a bending torque required for trueing the thickened end portions 4*a* of the article 4.

The dimensions and curvature of the central portions 3 and 7, respectively, of the support roll 1 and of the pressure roll 5 are selected, as it has been already explained, so that they should provide for a bending torque sufficient for trueing the thickened end portions 4*a* of the article 4. Furthermore, the dimensions and the curvature of the projection 7*a* are selected to provide a bending torque value which at the trueing of the narrow central portion 4*b* of the article 4 should not exceed the maximum permissible value and at the trueing of the thickened end portions 4*a* should not be short of the minimum permissible value sufficient for trueing these thickened end portions.

The support roll 1 and the pressure roll 5 are mounted at an angle relative to each other, so that the axis 10 of the support roll 1 (FIG. 2) and the axis 10*a* of the pressure roll 5 extend at angles $\alpha_1$ and $\alpha_2$, respectively, relative to the trueing axis 11. It is possible that the angles $\alpha_1$ and $\alpha_2$ are equal in an embodiment of the present invention.

The angles $\alpha_1$ and $\alpha_2$ are preferably selected within a range from 5° to 20°, so that they should provide for feeding an article into the pass, for the helical motion of the article and for the delivery of this article 4 from the trueing pass, as well as for centering the article and bending it to the required degree. The actual values of the angles $\alpha_1$ and $\alpha_2$ should ensure the required rate of the trueing and preclude jamming of the article, as it is being driven in the process of the trueing operation, the rate of the trueing increasing and the bending torque decreasing with the angle of the skewing of the rolls relative to the trueing axis increasing. The article-centering conditions are the better, the smaller is this angle of the skewing of the axes of the rolls.

The herein disclosed rolls can be mounted in a twin-roll trueing machine, as well as in a multi-roll one having either two or more roll couples.

Figure 5:
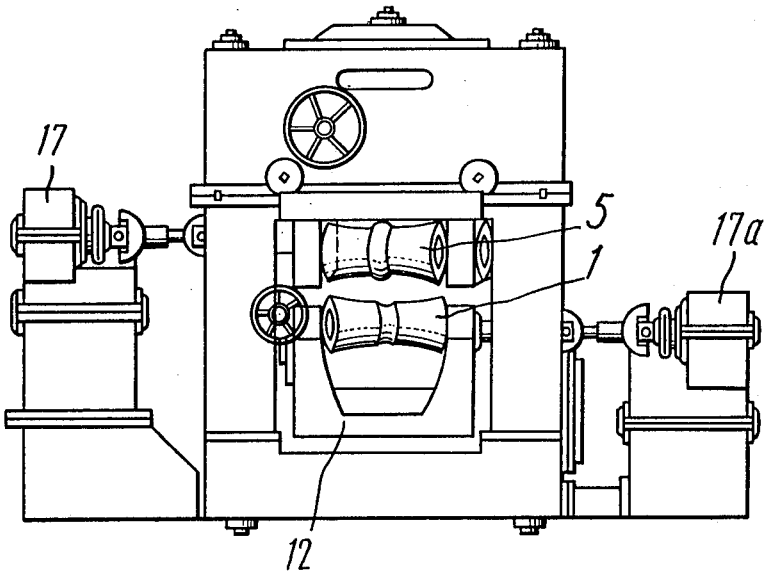
FIG. 5 is a schematic general view of a skewed-roll trueing machine incorporating rolls for trueing cylindrical metal articles, according to the present invention.
Figure 6:
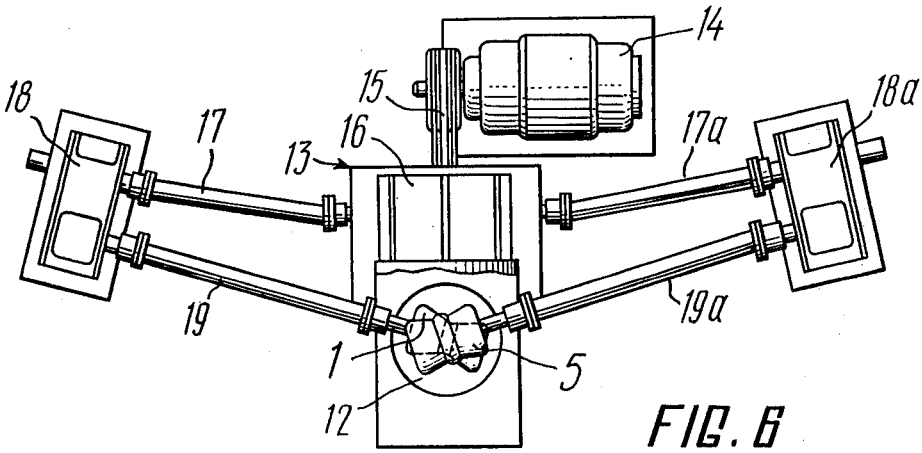
FIG. 6 shows the machine of FIG. 5 in a plan view, with the drive means of the rolls shown more clearly.

In an application of the rolls in accordance with the present invention in a twin-roll trueing machine (FIGS. 5, 6), the pressure roll 5 and the support or back-up roll 1 are mounted on respective rotary tables 12 (FIG. 6).

In the presently described embodiment the drive 13 includes an electric motor 14 coupled with a differential gear 16. The differential gear 16 is operatively connected via shafts 17 and 17*a*, respectively, with reducers 18 and 18*a* connected via shafts 19 and 19*a* with the rolls 1 and 5. The differential gear 16 is included to provide for synchronous transmission of the rotation to the driving shafts of the reducers 18 and 18*a* which drive the rolls 1 and 5 through their output shafts 19 and 19*a*.

An article with thickened end portions is trued by the herein disclosed rolls, as follows. The rolls 1 and 5 are mounted so that the spacing therebetween and the angles $\alpha_1$ and $\alpha_2$ between their axes 10, 10*a* and the trueing axis 11 (FIG. 2) should correspond to the diameter of the thickened end portion 4*a* of the article 4 (FIG. 3) and that the rolls 1 and 5 should engage the thickened end 4*a* of the article 4 to be trued.

With the rolls set, the motor 14 (FIG. 6) is energized to rotate the rolls 1 and 5 in the same direction, whereafter an article is introduced into their nip. The skewed rolls 1 and 5 engage the articles and, owing to friction therebetween, drive this article through a helical motion and advance it through the trueing pass.

As the article 4 (FIG. 3) is driven through this helical motion, its thickened end 4*a* successively passes through the inlet, central and outlet zones of the trueing couple or pass, defined, respectively, between the portions 2 and 6, 3 and 7, 2*a* and 6*a* of the rolls 1 and 5. The trueing of the thickened end portion 4*a* of the article 4 in this case is effected predominantly by the combination of repeated flexing or sign-variable bending with the transverse rolling of the end portions in the trueing couple.

The narrow central portion 4*b* of the article 4 (FIG. 4) in the course of the helical motion through the trueing couple is being trued by repeated flexing or sign-variable bending brought about by the load applied to this narrow portion 4*b* by the projecting strip 7 of the roll 5, the portions 2 and 2*a* of the roll 1 acting in this case as the supports or back-up areas.

Articles may be trued by either one, or two, or even more couples of the herein disclosed type, mounted in a skewed-roll trueing machine.

If the number of the couples is two or more, the profiles of the rolls making up the successive couples can be either the same, defining in different roll couples the same trueing pass in every couple, or else they may be different and define a trueing pass varying from one roll couple to the successive one.

Industrial tests which have been carried out with rolls constructed in accordance with the present invention have brought positive results. The rolls have been found to true cylindrical articles with thickened ends throughout the length of the articles, in a single pass through the rolls.

What we claim is:

1. A skewed-roll trueing machine for trueing cylindrical metal articles having a narrow central portion and a thickened end portion wherein the plastic torque of the bending resistance of the cross-section of the thickened end portion of the article to be trued exceeds the plastic torque of the bending resistance of the cross-section of the narrow central portion of the article to be trued by not more than 10%, comprising a pair of rolls, means for positioning said rolls at an angle with respect to the trueing axis and at an angle with respect to each other and means for spacing said rolls apart corresponding to the diameter of the article to be trued, said pair of rolls comprising a support roll in the form of a body of rotation with a biconcave profile wherein the portions of said support roll adjoining the ends thereof have a hyperboloidal concave surface for engaging the narrow central portion of the article to be trued, and the central portion of said support roll has a hyperboloidal concave surface for bending the thickened end portion of said article to be trued, wherein the curvature of said central portion of said support roll is greater than the curvature of the portions adjoining the ends of said support roll, a pressure roll in the form of a body of rotation with a convexo-concave profile wherein the portions of said pressure roll adjoining the ends thereof have a hyperboloidal concave surface with a curvature for engaging the thickened end portion of the article to be trued, and the central portion of said pressure roll comprises a radially projecting strip means having a curvilinear profile and a radial height for producing a bending torque on the article to be trued less than the maximum permissible value required for trueing the narrow central portion of the article to be trued and not less than the minimum permissible value required for trueing the thickened end portion of the article to be trued.

2. A skewed-roll trueing machine as claimed in claim 1 wherein said means for positioning said rolls comprise positioning said rolls such that the axis of the rolls with respect to the trueing axis is at an angle between 5° to 20°.

* * * * *